US008347538B2

(12) United States Patent
Hayden

(10) Patent No.: US 8,347,538 B2
(45) Date of Patent: Jan. 8, 2013

(54) FIREARM APPARATUS TO BE WORN ON THE USER'S FOREARM

(76) Inventor: Paul Jacob Hayden, Owensboro, KY (US)

( * ) Notice: Subject to any disclaimer, the term of this patent is extended or adjusted under 35 U.S.C. 154(b) by 118 days.

(21) Appl. No.: 13/065,234

(22) Filed: Mar. 17, 2011

(65) Prior Publication Data

US 2011/0265364 A1 Nov. 3, 2011

Related U.S. Application Data

(60) Provisional application No. 61/343,748, filed on May 3, 2010.

(51) Int. Cl.
*F41C 9/00* (2006.01)

(52) U.S. Cl. ..... 42/1.11; 89/136

(58) Field of Classification Search ..... 42/1.11; 89/136, 137

See application file for complete search history.

(56) References Cited

U.S. PATENT DOCUMENTS 8,091,264 B2 * 1/2012 Goertz ..... 42/1.11

* cited by examiner

*Primary Examiner* — Daniel J Troy
(74) *Attorney, Agent, or Firm* — Gary K. Price

(57) ABSTRACT

A firearm apparatus to be worn on the user's forearm generally having a firearm body that includes a magazine pack and a power source box that extend on opposite sides of the firearm body for supporting the firearm on the wearer's forearm. The combination of a base surface of the gun body with the magazine pack and the power source box further defines an open sleeve that conforms to the wearer's forearm with first and second fastener material straps for securing the user's forearm for operation of the firearm apparatus. The gun body has an electrical wire that is electrically connected to the firearm's internal triggering assembly and the firearm's external triggering means. The electrical wire includes a first connect and a second connect such that the firearm apparatus is operable by touching the first connect with the second connect in order to complete the electrical circuit.

17 Claims, 3 Drawing Sheets

FIREARM APPARATUS TO BE WORN ON THE USER'S FOREARM

CROSS REFERENCES TO RELATED APPLICATIONS

U.S. Provisional Application for Patent No. 61/343,748, filed May 3, 2010, with title "Firearm Apparatus to be Worn on the User's Forearm" which is hereby incorporated by reference. Applicant claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates to an electronic apparatus that is a firearm apparatus capable of selectively discharging various projectiles, and more particularly to a firearm apparatus adapted to be worn on the user's forearm and to be fired by action of the user's hand.

2. Brief Description of Prior Art

In today's market for projectile apparatuses, there is a continued demand for electronic firearms having advanced capabilities and appearance. There is therefore a need to provide a firearm apparatus which will revolutionize the entire field of projectile apparatuses.

The prior art is well supplied with variations and designs of projectile firearms that can be primarily differentiated by appearance. While each of the prior art firearms may incorporate various designs and/or appearances, none of these provide the features of the current invention.

Thus there is a continuing need for a firearm apparatus that has the advantages of (1) a firearm that the user may keep attached to his person at all relevant times without undue difficulty, (2) a firearm apparatus that has its triggering mechanism conveniently activated by action of the user's hand. Further, it is advantageous for such a firearm apparatus to not rotate or shift and to have proper balance on the user's forearm while being worn. The present firearm apparatus meets these objectives.

SUMMARY OF THE INVENTION

A firearm apparatus to be worn on the user's forearm generally having a firearm body that includes a magazine pack and a power source box that extend on opposite sides of the firearm body for supporting the firearm on the wearer's forearm. The combination of the magazine pack and power source box disposed on opposite sides of the firearm body further balances the weight of the firearm apparatus on the user's forearm during application. In addition, the combination of a base surface of the gun body with the magazine pack and the power source box further defines an open sleeve that conforms to the wearer's forearm with first and second fastener material straps for securing the user's forearm for operation of the firearm apparatus. The gun body includes an electrical wire that is electrically connected at a first end to the firearm's internal triggering assembly and connected at a second end to firearm's external triggering means. The second end having a first connect and a second connect. Discharging or firing the firearm apparatus is operable by touching the first connect with the second connect in order to complete the electrical circuit. Preferably, the firearm apparatus includes a glove that is worn by the user during application. The glove includes at least two (2) fingers wherein a first finger has a first contact pad electrically connected to the first connect for example on a thumb, and a second finger has a second connect pad that is electrically connected to the second connect for example on a knuckle or finger tip area such that touching the first contact pad with the second contact pad completes the electrical circuit causing the firearm to fire.

DESCRIPTION OF THE PREFERRED EMBODIMENT

The apparatus of the present invention is directed to a firearm apparatus adapted to be worn on the user's forearm and fired by action of the user's hand. The present invention utilizes a balanced configuration in order to avoid the firearm apparatus from shifting or rotating on the user's forearm during application. In the broadest context, the firearm of the present invention consists of components configured and correlated with respect to each other so as to attain the desired objective.

Figure 1:
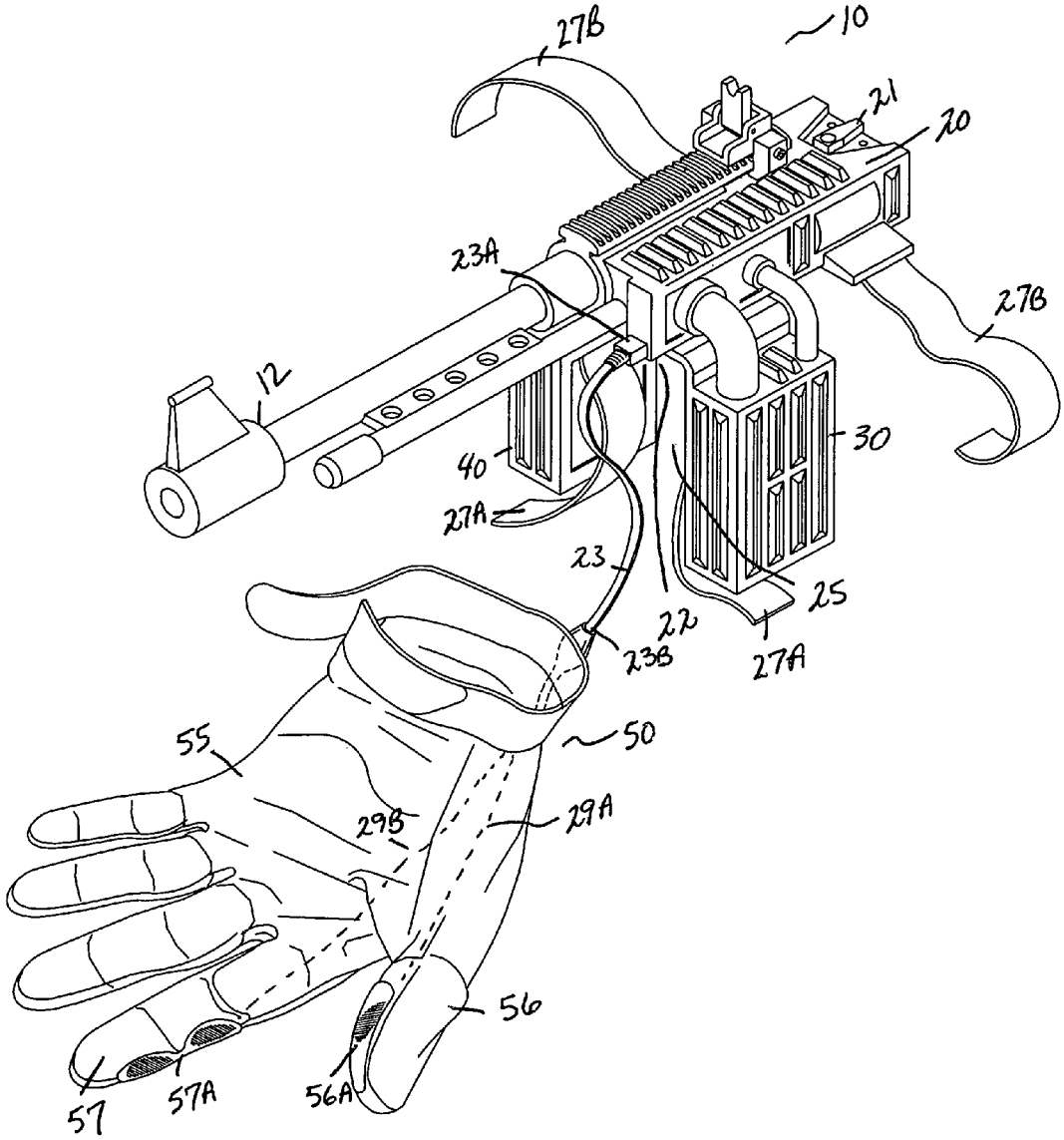
FIG. 1 illustrates a preferred embodiment of the present invention, a firearm apparatus to be worn on the user's forearm.
Figure 2:
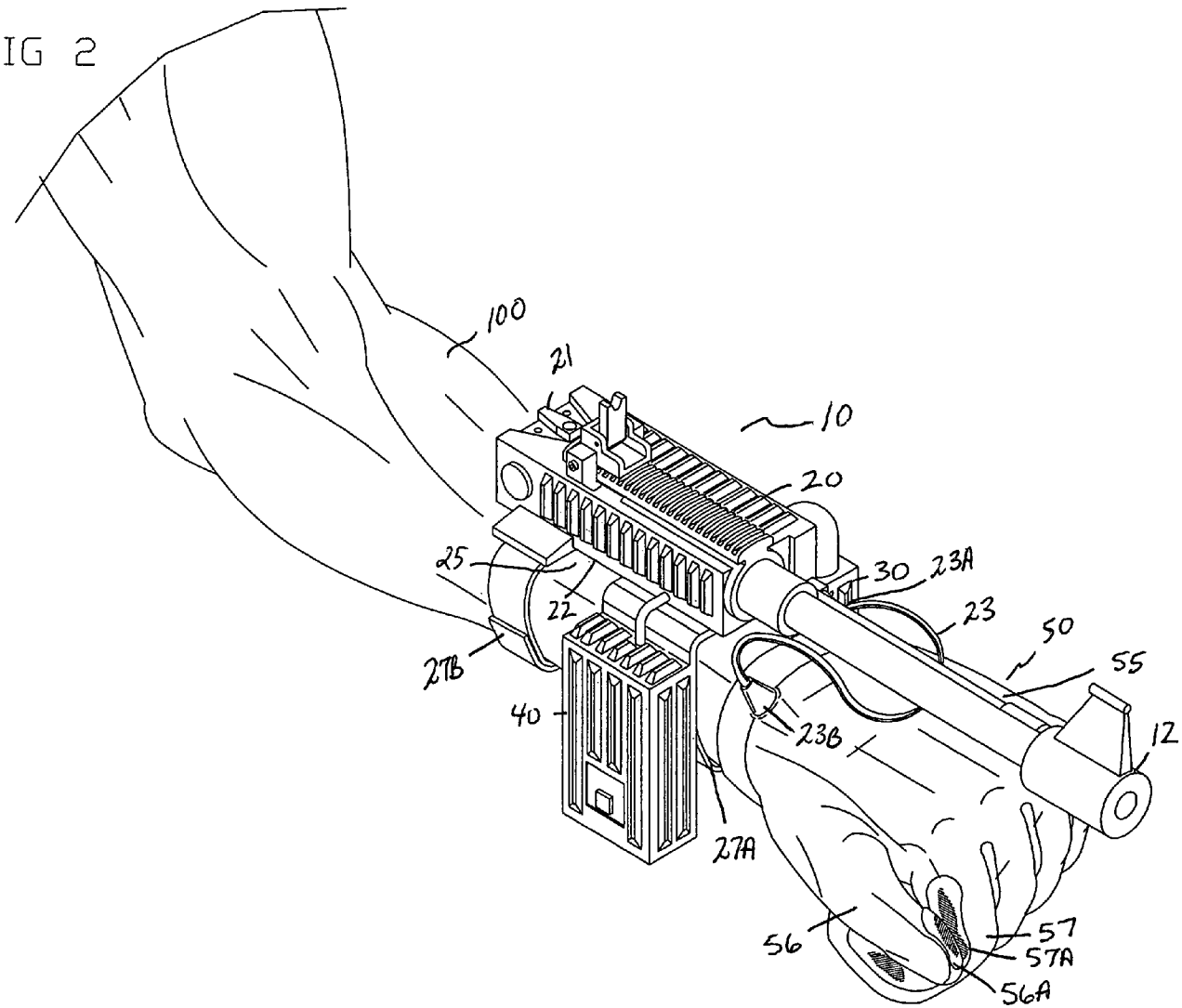
FIG. 2 further illustrates the firearm apparatus of FIG. 1 in application.

Referring to FIGS. 1-2, the firearm apparatus, indicated generally at 10, comprises a firearm body 20 that includes a magazine pack 30 for supplying selected projectiles or ammunition to the firearm body 20 and a power source box 40 for supplying electricity to the firearm body 20 opposite the magazine pack 30. The power source box 40 may consist of a battery pack or other power source that is known in the relevant art. The projectiles or ammunitions might be paintballs, pellets, fluid, bullets or other projectiles for example.

As illustrated the magazine pack 30 and power source box 40 extend perpendicular to the barrel 12 and on opposite sides of the firearm body 20 for supporting the firearm 10 on the wearer's forearm 100 and can be rotatable to various positions for increased comfort, clearance, efficient transport and balance. As further illustrated, the magazine pack 30 and power source box 40 are each attached to a base surface 22 of the gun body 20. Further, the combination of the magazine pack 30 and power source box 40 disposed on opposite sides of the firearm body 20 as described effectively balances the weight of the firearm apparatus 10 on the user's forearm 100 during application. It should be understood this balancing feature is unique from the prior art and helps prevent the firearm apparatus 10 from shifting or rotating on the user's forearm 100 during application.

The combination of the base surface 22 of the gun body 20 with the magazine pack 30 and the power source box 40 further defines an open sleeve 25 that conforms to the wearer's forearm 100 with a VELCRO e.g., hook and loop type fastener material strap 27A, or other similar attachments or sleeves, for securing the user's forearm 100 for operation of the firearm apparatus 10 as shown in FIG. 2. The gun body 20 preferably includes a second similar fastener 27B for further securing the apparatus 10 to the user's forearm 100.

The gun body 20 also includes an on-off switch/safety 21, and an electrical wire 23 that is electrically connected at one end 23A to the firearm's internal triggering assembly (not shown) and connected at the opposite end 23B to the firearm's external triggering means 50.

It should be understood that the internal triggering assembly is known in the art and not claimed in the present invention except for its interface with the firearm's external triggering means 50 as will be discussed, and that the present invention can be fired in a similar manual fashion if so desired without the electrical circuit being completed.

As illustrated, the firearm's external triggering means 50, in the preferred embodiment, generally includes the end of the electrical wire 23B having a first flexible connect 29A and a second flexible connect 29B (illustrated by dashed lines in FIG. 1). In its simplest form, discharging or firing the firearm apparatus 10 is operable by touching the first connect 29A with the second connect 29B in order to complete the electrical circuit. In the preferred embodiment, and as illustrated, the apparatus 10 includes a flexible glove 55 that is worn by the user during application. The glove 55 can include two (2) electrical contact points on opposing portions of the glove 55 for example, the glove 55 includes at least two (2) finger wherein a first finger 56 has a first contact pad 56A electrically connected to the first connect 29A, and a second finger 57 as a second connect pad 57A that is electrically connected to the second connect 29B. In application, touching the first contact pad 56A with the second contact pad 57A (shown in FIG. 2) completes the electrical circuit causing the firearm 10 to fire. The contact pads 56A and 57A can be made from a flexible, electrically conductive material. The wire 23 lets the glove 55 move relative to the gun body 10 while remaining electrically connected to the internal trigger.

It should be understood that while the external triggering means 50 of the preferred embodiment includes the glove 55 with first and second contact pads, other activation means such as, but not limited to, a wrist band where cocking the user's wrist causes touching of the first and second connect 29A, 29B; or a pad held by the user where squeezing the pad causes the first and second connects 29A, 29B to touch, and other similar means can be implemented in place of the glove 55 disclosed. The external trigger means 50 plus the internal switch 21 and the firearm's internal triggering assembly comprise an electrical circuit used for firing the gun 10.

Referring to FIG. 2, a perspective view of the firearm apparatus shows the apparatus being worn on the user's forearm 100. As illustrated, the firearm is preferably worn such that the barrel 12 of the firearm 10 substantially parallels the user's forearm 100 and the direction of the fingers. When the user's first is doubled up, the fingers are removed from the line of fire of the apparatus. Thus when the user becomes engaged in "fighting", the user need only double up the first of the hand to which the firearm is attached, and strike his/her adversary accordingly.

It should be appreciated by those of ordinary skill in the art that firearm apparatus 10 will allow for a quick and efficient means for wearing the firearm and firing the firearm with a simple action of the user's hand, regardless of the type projectile. Use of various projectiles may require modifications to the gun body however, should not result in substantial modifications to the teaching herein of: (1) a firearm that the user may keep attached to his person at all relevant times without undue difficulty, (2) a firearm apparatus that has its triggering mechanism conveniently activated by action of the user's hand.

Figure 3:
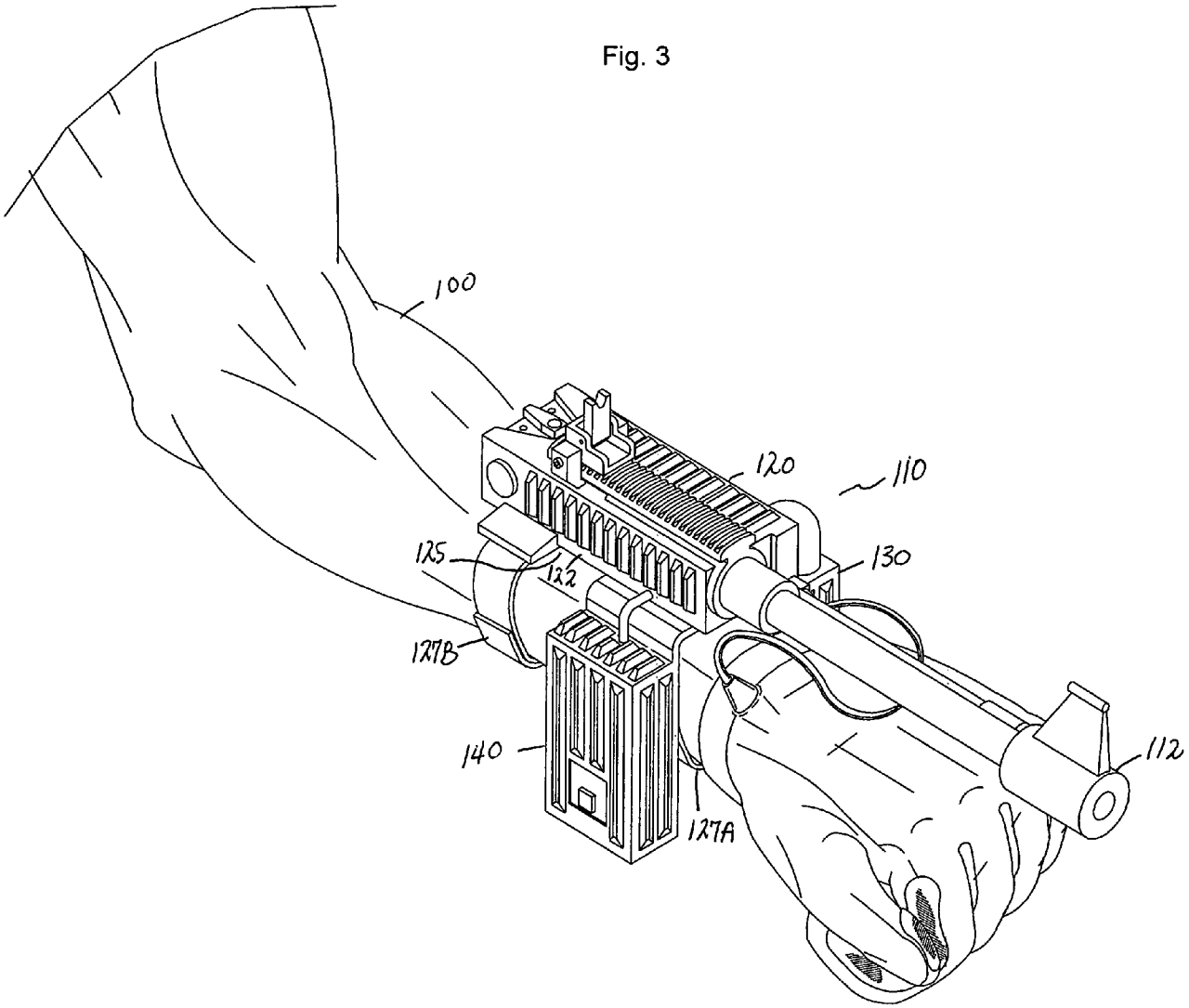
FIG. 3 illustrates an alternate embodiment of the present invention

FIG. 3 illustrates an alternate embodiment of the present invention. Referring to FIG. 3, the firearm apparatus, indicated generally at 110, comprises a firearm body 120 that includes a first magazine pack 130 for supplying selected projectiles or ammunition to the firearm body 120 and a second magazine pack 140 for further supplying selected projectiles or ammunition to the firearm body 120. The second magazine pack 140 opposite the first magazine pack 130. The projectiles or ammunitions might be paintballs, pellets, fluid, bullets or other projectiles for example.

As illustrated, the magazine packs 130, 140 extend approximately perpendicular to the barrel 112 and on opposite sides of the firearm body 120 for supporting the firearm 110 on the wearer's forearm 100 and can be rotatable to various positions for increased comfort, clearance, efficient transport and balance. As further illustrated, the first and second magazine packs 130, 140 are each attached to a base surface 122 of the gun body 120. Further, the combination of the first and second magazine packs 130 and 140 disposed on opposite sides of the firearm body 120 as described effectively balances the weight of the firearm apparatus 110 on the user's forearm 100 during application. It should be understood this balancing feature is unique from the prior art and helps prevent the firearm apparatus 110 from shifting or rotating on the user's forearm 100 during application.

The combination of the base surface 122 of the gun body 120 with the first and second magazine packs 130 and 140 further defines an open sleeve 125 that conforms to the wearer's forearm 100 with a Velcro e.g. hook and loop type fastener material strap 127A for securing the user's forearm 100 for operation of the firearm apparatus 110. The gun body 120 preferably includes a second similar fastener 127B for further securing the apparatus 110 to the user's forearm 100.

The firearm apparatus 110 further includes a power source (not shown) that is known in the relevant art. As is further known, the power source can be external to the firearm apparatus 110 or can be included in the firearm body 120.

The firearm apparatus 110 utilizes the electrical wiring, internal triggering assembly and external triggering means as previously defined in the preferred embodiment.

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A firearm apparatus to be worn on a user's forearm comprising:

a firearm body that includes a magazine pack and a power source box that extend on opposite sides of the firearm body, wherein the combination of the magazine pack and power source box disposed on opposite sides of the firearm body balance the weight of the firearm apparatus for supporting the firearm apparatus on a user's forearm during application, said firearm body further including a base surface, wherein the combination of said base surface with said magazine pack and said power source box defines an opening for receiving the user's forearm, said firearm body further includes first and second fastener material straps for securing the firearm body to the user's forearm for operation of the firearm apparatus, an electrical wire that is electrically connected at a first end to an internal triggering assembly and connected at a second end to an external triggering means, wherein said second end having a first connect and a second connect such that said firearm apparatus is operable by touching the first connect with the second connect in order to complete the electrical circuit.

2. The firearm apparatus as recited in claim 1, wherein said external triggering means includes a glove comprising at least two fingers wherein a first finger has a first contact pad electrically connected to the first connect, and a second finger has a second connect pad that is electrically connected to the second connect such that touching the first contact pad with the second contact pad completes the electrical circuit.

3. The firearm apparatus as recited in claim 2, wherein the electrical wire is flexible and attaches said glove to said firearm body such that said glove can move relative to said firearm body while remaining in electrical connection to said internal triggering assembly.

4. The firearm apparatus as recited in claim 2, wherein the first and second connect and first and second connect pads are made from flexible, electrically conductive material.

5. The firearm apparatus as recited in claim 1, wherein said magazine pack and power source box extend from said firearm body in a direction perpendicular to a barrel of said firearm body.

6. A firearm apparatus to be worn on a user's forearm comprising:

a firearm body that includes a magazine pack and a power source box that extend on opposite sides of the firearm body, wherein the combination of the magazine pack and power source box disposed on opposite sides of the firearm body help for maintaining the firearm apparatus on the user's forearm during application, said firearm body further including a base surface, wherein the combination of said base surface with said magazine pack and said power source box defines an opening for receiving the user's forearm, at least one strap for securing the firearm body to the user's forearm, an electrical wire that is electrically connected at a first end to an internal triggering assembly and connected at a second end to an external triggering means, wherein said second end having a first connect and a second connect such that said firearm apparatus is operable by touching the first connect with the second connect to complete an electrical circuit.

7. The firearm apparatus as recited in claim 6, wherein said external triggering means includes a glove comprising at least two opposing electrically conducting touch pads wherein a first pad is electrically connected to the first connect, and a second pad that is electrically connected to the second connect, such that touching the first contact pad with the second contact pad completes the electrical circuit.

8. The firearm apparatus as recited in claim 7, wherein the electrical wire is flexible and connects said glove to said firearm body such that said glove can move relative to said firearm body while remaining in electrical connection to said internal trigger.

9. The firearm apparatus as recited in claim 7, wherein the first and second connect and first and second pads are made from flexible, electrically conductive material.

10. The firearm apparatus recited in claim 7, wherein said magazine pack and power source box extend from said firearm body in a direction perpendicular to a firearm barrel of said firearm body.

11. A firearm apparatus comprising:

a firearm body that includes a first pack and a second pack that extend on opposite sides of the firearm body, wherein the combination of the first pack and second pack disposed on opposite sides of the firearm body for balancing the firearm apparatus on a user's forearm during application, said firearm body further including a base surface, wherein the combination of said base surface with said first and second packs define an opening for positioning on the user's forearm, at least one fastener material strap for securing the firearm body to the user's forearm, an electrical conductor that is electrically connected at a first end to an internal triggering assembly and connected at a second end to an external trigger, wherein said second end having a first connect and a second connect such that said firearm apparatus is operable by touching the first connect with the second connect to complete an electrical circuit.

12. The firearm apparatus as recited in claim 11, wherein said external trigger includes a glove comprising at least two opposing electrically conducting touch pads wherein a first pad is electrically connected to the first connect, and a second pad is electrically connected to the second connect such that touching the first connect pad with the second connect pad completes the electrical circuit to fire the firearm.

13. The firearm apparatus as recited in claim 12, wherein the electrical conductor is flexible and connects said glove to said firearm body such that said glove can move relative to said firearm body while remaining in electrical connection to said internal triggering assembly.

14. The firearm apparatus as recited in claim 13, wherein the first and second connect and first and second pads are made from flexible, electrically conductive material.

15. The firearm apparatus as recited in claim 14, wherein said first and second packs extend from said firearm body in a direction perpendicular to a barrel of said firearm body.

16. The firearm apparatus as recited in claim 15, wherein said first pack is a magazine pack and wherein said second pack is a power source box.

17. The firearm apparatus as recited in claim 15, wherein said first pack is a first magazine pack and wherein said second pack is a second magazine pack.

* * * * *